US005769568A

United States Patent [19]

Parkins et al.

[11] Patent Number: 5,769,568

[45] Date of Patent: Jun. 23, 1998

[54] ADAPTABLE BOAT LIFT

[75] Inventors: David G. Parkins, Ft. Lauderdale; John D. Meehan, Sarasota, both of Fla.

[73] Assignee: ABL Boat Lifts, Ft. Myers, Fla.

[21] Appl. No.: 783,318

[22] Filed: Jan. 15, 1997

[51] Int. Cl.[6] ..... E02C 5/00; B63C 3/06

[52] U.S. Cl. ..... 405/3; 114/44

[58] Field of Search ..... 405/1, 3; 114/44, 114/50, 57

[56] References Cited

U.S. PATENT DOCUMENTS

| | | | |
|---|---|---|---|
| 3,252,589 | 5/1966 | Keene et al. | 405/3 X |
| 4,641,596 | 2/1987 | Reprogle et al. | 405/3 X |
| 4,686,920 | 8/1987 | Thomas | 405/3 |
| 4,773,346 | 9/1988 | Blanding et al. | 114/45 |
| 5,427,471 | 6/1995 | Godbersen | 405/3 |
| 5,522,671 | 6/1996 | Keesling | 405/3 |
| 5,593,247 | 1/1997 | Finere et al. | 405/3 |
| 5,709,501 | 1/1998 | Elbers | 405/3 |

*Primary Examiner*—Tamara L. Graysay
*Assistant Examiner*—Frederick L. Lagman
*Attorney, Agent, or Firm*—Russell & Russell, LLP

[57] ABSTRACT

An adaptable boat lift for use in raising and lowering boats having a weight of up to about sixty thousand pounds. The boat lift is able to safely support heavy boats with an upgradeable design that is adaptable to boats of varying weights and sizes by adding or changing the components of the boat lift. The boat lift has a plurality of support pilings, one piece extruded support beams, a drive shaft enclosed within the support beams, bearings attached to the support beam and surrounding the drive shaft, a mechanism for rotating the drive shaft, cradle beams to support the boat, and lifting members attached to the support beam, cradle beam and drive shaft so that when the drive shaft is rotated the boat is raised or lowered. In one embodiment, the support beams are formed as a one piece extrusion of an aluminum alloy suitable for marine use. The boat lift is adaptable to support boats of varying weights and sizes by varying one or more of the following: the number of pilings, the length of the support beams, the spacing between the pilings, the thickness and length of the cradle beams, the number of mechanisms for rotating the drive shaft, and the size and the number of bearings attached to the support beams and surrounding the drive shaft.

34 Claims, 8 Drawing Sheets

ADAPTABLE BOAT LIFT

BACKGROUND

The invention relates generally to boat lifts and, more particularly, to a boat lift apparatus and its method of use that is adaptable for lifting and supporting boats having a weight of up to about sixty thousand pounds.

Attention is called to U.S. Pat. Nos. 4,773,346; 5,522,671; and 5,427,471.

To limit the effects of water on boats and to protect boats against damage when the water level or tide rises, boats are frequently taken out of the water when not in use and stored safely above the water and tide line. This can be accomplished by using a stationary lift, attached to a dock or pilings, to raise and lower the boat. Boat owners store boats of all sizes out of the water, even boats up to sixty thousand pounds. Many existing boat lifts are not capable of being used with these heavy boats. Additionally, many boat lift owners buy new and often larger boats, and then must replace the entire boat lift because it cannot lift the larger boat. Most existing boat lifts cannot be redesigned and adapted for different types of boats.

For economy, strength and reduced corrosion, most boat lifts have support beams that are cut from aluminum I-beams and welded together to achieve the necessary length. However, heat from the welding process destroys the temper of the aluminum, thus locally reducing the strength of the parent metal and resulting in the lack of a uniform material with uniform strength. This generally precludes the use of aluminum as a direct substitute for steel without considerable redesign of the welded connection. Because these welds are costly to make and reduce the strength of the beam, this limits the size of the boat that can be safely lifted and adds to the production cost. This cutting of the I-beam also results in wasted material that is costly. Many of these existing boat lift designs have moving parts that are exposed to the elements and may pose safety problems since the moving parts are also exposed to humans in the vicinity of the lift. Many of the existing boat lifts are time consuming to install because they need on-site welds. They also may be expensive to maintain and to replace failed parts since they may have components that are welded or otherwise not easily replaceable.

For the foregoing reasons, there is a need, therefore, for an aluminum boat lift that resists corrosion but is not welded and which can safely support boats weighing up to sixty thousand pounds. Therefore, it is desirable for the boat lift to have with an easily upgradeable design, that requires little or no redesign, with existing components added or upgraded to adapt the boat lift to varying weights, hull configurations and sizes of boats up to a maximum weight of sixty thousand pounds. For ease of maintenance, it is desirable that if a component of the boat lift fails, it can be quickly and easily replaced. It is also desirable that the moving parts of the boat lift be exposed to the elements as little as possible to prevent deterioration and for human safety reasons, while still making boat lift maintenance and replacement of components easy to do. In addition, since the weight, shapes and sizes of the boat to be raised or lowered differ greatly, the lift device needs to be capable of operating with many different sizes of boats, having different topside configurations and gunnels of varying sizes. Because the lift device is to be used in lake water or in salt water, the device must be resistant to corrosion. In addition to these requirements for the lift device apparatus, the lift device itself must be easily and inexpensively fabricated, assembled and installed.

SUMMARY

The present invention is directed to a device, method of use and method of manufacture that satisfies these needs. The present invention provides for a boat lift that is able to safely support heavy boats with an upgradeable design that is adaptable to boats of varying weights and sizes by adding components or changing current components, without requiring a new boat lift to be purchased. The present invention provides for extruded beams of uniform strength which decrease waste and result in a stronger structure, conceal moving parts from the elements and from humans, have all bolted and no welded components, and is easy to fabricate, install and maintain.

An adaptable boat lift for supporting a boat comprises a plurality of support pilings arranged in a rectangle shape. A one piece extruded support beam is attached to each support piling that forms one side of the rectangle. A drive shaft is enclosed within and extends the length of each support beam. A mechanism is provided for rotating the drive shaft in either a clockwise or counterclockwise position so as to be able to raise or lower the boat lift. A plurality of cradle beams, are spaced parallel to each other and sufficiently far apart to support a boat hull and are located below the support beams and are oriented at a ninety degree angle to the support beams. A plurality of lifting members, each lifting member comprising an elongated cable connected on one end to the support beam, attached to the cradle beam, and connected on the opposite end to the drive shaft so that when the drive shaft is rotated, the lifting member raises or lowers the cradle beams.

In an alternative embodiment, the support beams are C-shaped channel extruded beams with an opening on one side, mounted on the top of the support pilings so that the opening faces the top of the support pilings. The C-shaped channel support beams may have a reinforced ribbed top section extending the length of the support beam. The extruded beams may be formed of an aluminum alloy suitable for marine use, such as 6061-T6.

In an another alternative embodiment, one or more bearings are mounted surrounding the drive shaft and are attached to the underside of the channel support beam. The bearings may be cast of aluminum alloy. In an alternative embodiment, the number of bearings and the bearing size are matched to the weight of the boat that is to be lifted.

In an alternative embodiment, one or more bearings are mounted surrounding the drive shaft and are attached to the underside of the channel support beam, and a pulley is attached to each end of the lower cradle beams so that the lifting members extend through the pulley and support the cradle beams through the pulley. The mechanism for rotating the shaft is a motor attached to the support pilings.

In an another alternative embodiment, a plurality of support pilings forming pairs are spaced so as to form a rectangle. A C-shaped channel one piece extruded support beam with an opening on one side is mounted atop each pair of the support pilings that form one side of the rectangle such that the opening in the support beam faces the top of the support pilings. A drive shaft is mounted within the opening of each channel support beam and extends the length of the channel support beam. One or more bearings are mounted on the drive shaft and are attached to the underside of the channel support beams. A motor mechanism for rotating the drive shaft is attached to the support piling. A plurality of lower cradle beams, place parallel to each other and spaced sufficiently far apart to support a boat are located below the channel support beams and are oriented at a ninety degree angle to the channel support beams. A cable is affixed to the support beam on one end and to the drive shaft on the other end and extends through the pulley. A plurality of boat bottom supporting mechanisms are placed parallel to each other and spaced sufficiently far apart to allow a boat to be supported and are oriented at a ninety degree angle to the cradle beams for supporting a boat. A plurality of guide posts are attached to the top surface of the lower cradle beams and are spaced sufficiently apart to allow the hull of a boat to fit between the guide posts.

In an alternative embodiment, two drive shafts are enclosed within and extending the length of each support beam, with each drive shaft being connected to a motor on each end of each support beam.

In an alternative embodiment, the number of support pilings is equal to four, forming two pairs and the number of extruded support beams is equal to two. In an alternative embodiment, the number of lower cradle beams equals two, the number of pulleys equals four, and the number of cables equals two. In one embodiment, the number of motors equals two. In another embodiment, the number of motors equals four.

In an alternative embodiment, the number of support pilings equals four, forming two pairs, and the number of extruded support beams equals two. In one embodiment, the number of lower cradle beams equals three, the number of pulleys equals six and the number of cables equals two. In one embodiment, the number of motors equals two. In another embodiment, the number of motors equals four.

In an alternative embodiment, the number of support pilings equals eight, forming four pairs and the number of extruded support beams equals four. In an alternative embodiment, the number of lower cradle beams equals four and the number of pulleys and cables equals eight. In another alternative embodiment, the number of lower cradle beams equals four, the number of pulleys equals eight and the number of cables equals four. In one embodiment, the number of motors equals four. In another embodiment, the number of motors equals eight.

In an alternative embodiment, the number of support pilings is equal to eight, forming four pairs and the number of extruded support beams is equal to four. In an alternative embodiment, the number of lower cradle beams equals six, the number of pulleys equals twelve and the number of cables equals four. Alternatively, the number of motors may be equal to four. Or alternatively, the number of motors may be equal to six. Alternatively, the number of motors may be equal to eight.

In an alternative embodiment, the channel support beams, drive shaft, bearings, motor mechanism and cradle beams are bolted into place for ease of installation, maintenance and replacement of failed or worn components and require no welded connections.

In an alternative embodiment, the boat lift is adaptable to lift a boat up to a maximum of about sixty thousand pounds by varying the number of support pilings from a minimum of two on each side of the rectangle to a maximum of four on each side of the rectangle.

In an alternative embodiment, the boat lift is adaptable to lift a boat up to a maximum of about sixty thousand pounds by increasing the thickness of the lower cradle beam.

In an alternative embodiment, the boat lift is adaptable to lift a boat up to a maximum of about sixty thousand pounds by matching the power of the motors to the load requirements of the boat to be lifted.

In an alternative embodiment, the boat lift is adaptable to lift a boat up to a maximum of about sixty thousand pounds by increasing the number of motors driving the shaft and attached to the support pilings from a minimum of two to a maximum of eight.

In an alternative embodiment, the boat lift is adaptable to lift a boat up to a maximum of about sixty thousand pounds by increasing the number of bearings mounted on the drive shaft and attached to the underside of the support beam.

In an alternative embodiment, the boat lift is adaptable to lift boats of varying weights and sizes by varying the number of pilings, varying the spacing between the pilings according to the length and weight of the boat, determining the length of the extruded support beam according to the spacing between the pilings, varying the thickness of the cradle beams according to the weight and length of the boat, selecting the number of motors for rotating the drive shaft according to the weight of the boat, and varying the size and number of bearings attached to the support beams and surrounding the drive shaft based on the weight of the boat.

In an alternative embodiment, if the boat to be lifted is up to about sixteen thousand pounds, the spacing between the pilings is a maximum of about eighteen feet and the cradle beams comprise a ten inch I-beam.

In an alternative embodiment, if the boat to be lifted is up to about twelve thousand pounds, the spacing between the pilings is a maximum of about eighteen feet and the cradle beams comprise a eight inch I-beam.

In an alternative embodiment, if the boat to be lifted is up to about ten thousand pounds, the spacing between the pilings is a maximum of about twelve feet and the cradle beams comprise a six inch I-beam.

In an alternative embodiment, the one piece extruded beam is formed of an aluminum alloy. In an alternative embodiment, the bearings are cast aluminum alloy.

BRIEF DESCRIPTION OF THE DRAWINGS

These and other features, aspects, and advantages of the present invention will become better understood with regard to the following description, appended claims, and accompanying drawings where:

DETAILED DESCRIPTION

Figure 1:
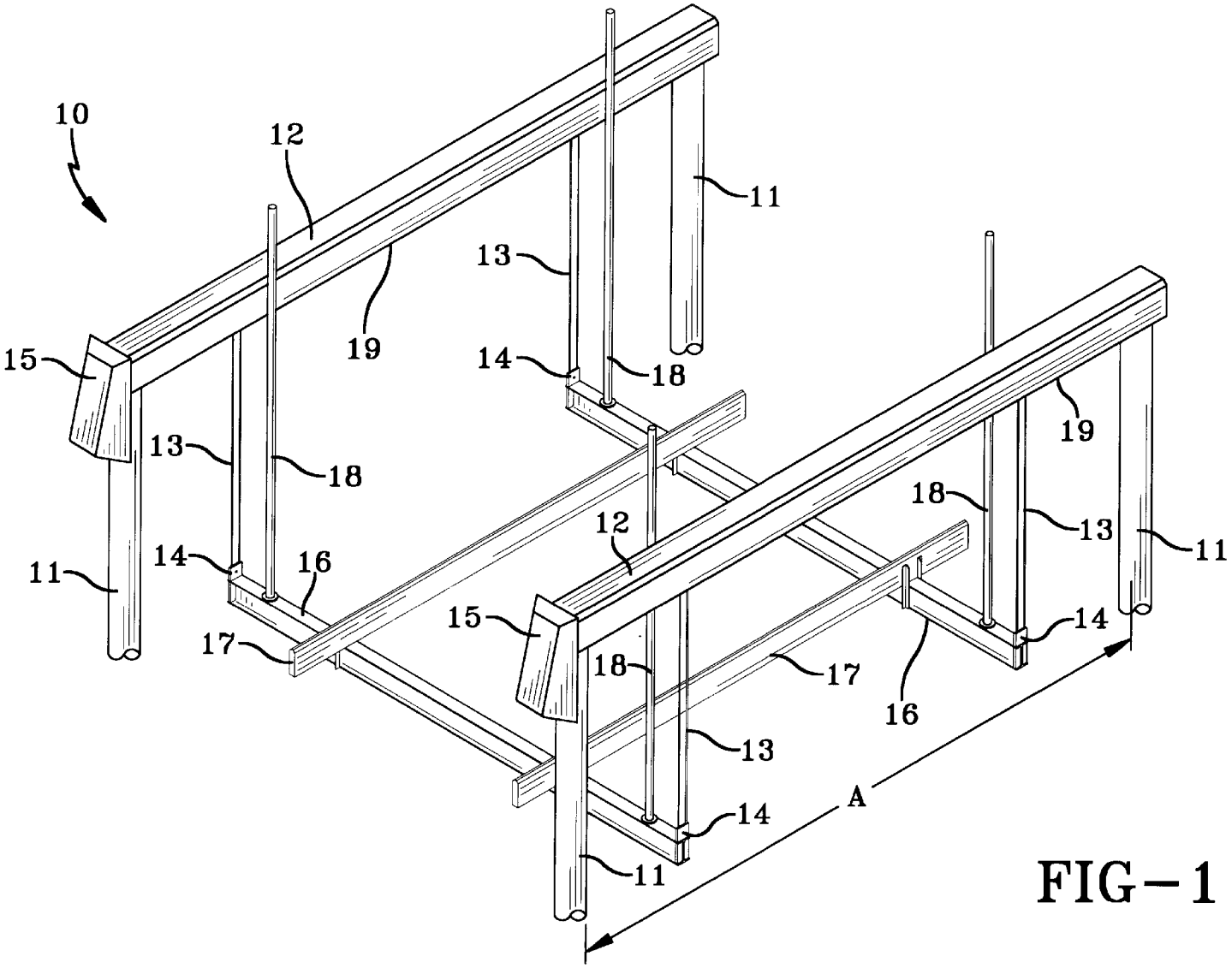
FIG. 1 shows a perspective view of an adaptable boat lift embodying features of the present invention.

Turning now to FIG. 1, a preferred embodiment of the boat lift 10 is shown in accordance with the present inventive concepts. The boat lift 10 comprises four support pilings 11, topped by support beams 12. A drive shaft is concealed within the underside 19 of the support beams 12. Two motors 15 are attached to the support pilings 11. Two lower cradle beams 16 are placed parallel to each and are located below and at a ninety degree angle from the support beams 12. pulleys 14 are connected to each end of the lower cradle beams 16. Cables 13 are affixed to the support beams 12. Boat bottom supporting beams 17 are placed parallel to each other and spaced sufficiently apart to allow a boat to be supported and are attached to and oriented at a ninety degree angle to the top surface of the cradle beams 16. Guide posts 18 are attached to the top surface of the cradle beams 16. The spacing A between the support pilings 11 is calculated based on the weight and length of the boat to be lifted.

Figure 2A:
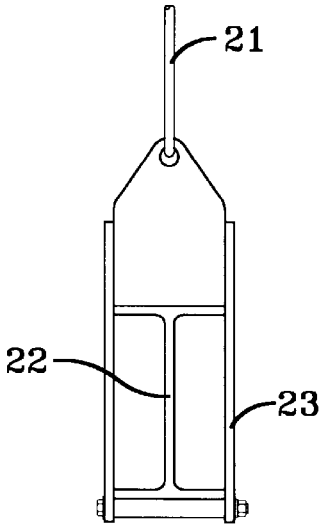
FIGS. 2A, 2B, 2C and 2D show side views of alternate embodiments of the lifting members and cradle beams of adaptable boat lift embodying features of the present invention.
Figure 2B:
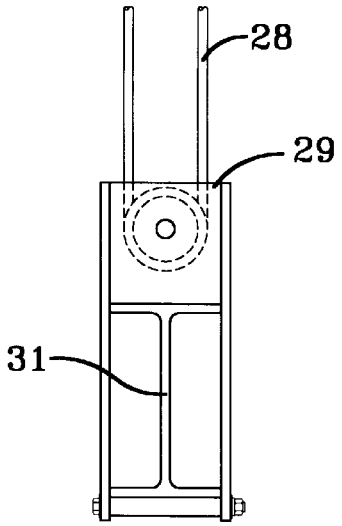
Figure 2C:
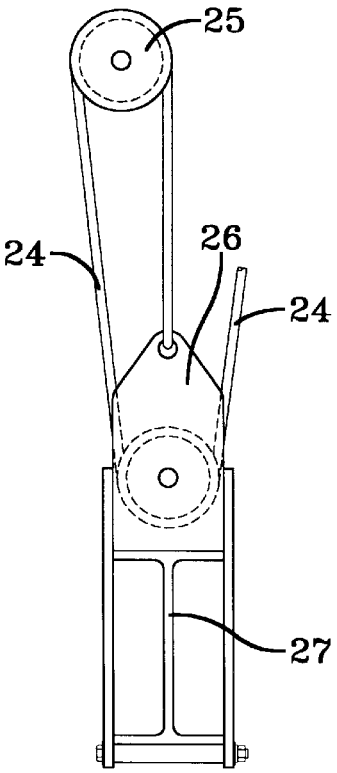
Figure 2D:
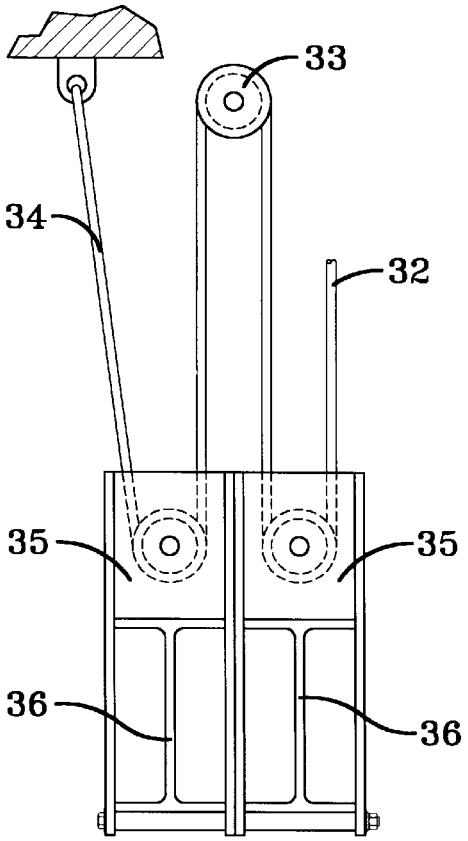

Turning now to FIGS. 2A, 2B, 2C and 2D, alternate embodiments of the lifting members and cradle beams of adaptable boat lift are shown embodying features of the present invention. In FIG. 2A, a cable 21 is shown connected to a six inch cradle beam 22 using a wishbone bracket 23. The embodiment shown in FIG. 2A can be used to lift boats of up to about seven thousand pounds. In FIG. 2B, a cable 28 is shown connected to an adjustable pulley box 29 which is attached to an eight inch cradle beam 31. The embodiment shown in FIG. 2B can be used to lift boats of up to about sixteen thousand pounds. In FIG. 2C, a cable 24 is shown surrounding a support beam pulley 25 which is connected to the support beam, which is not shown. The cable 24 extends through another pulley 26 which is attached to a a ten inch cradle beam. The embodiment shown in FIG. 2C can be used to lift boats of up to about twenty four thousand pounds. In FIG. 2D, a cable 32 is shown surrounding a support beam pulley 33 and the cable 32 is anchored on one end 34 to the support beam. The cable 32 extends through pulley boxes 35 which are attached to two ten inch cradle beams 36. The embodiment shown in FIG. 2D can be used to lift boats of up to about thirty two thousand pounds.

Figure 3:
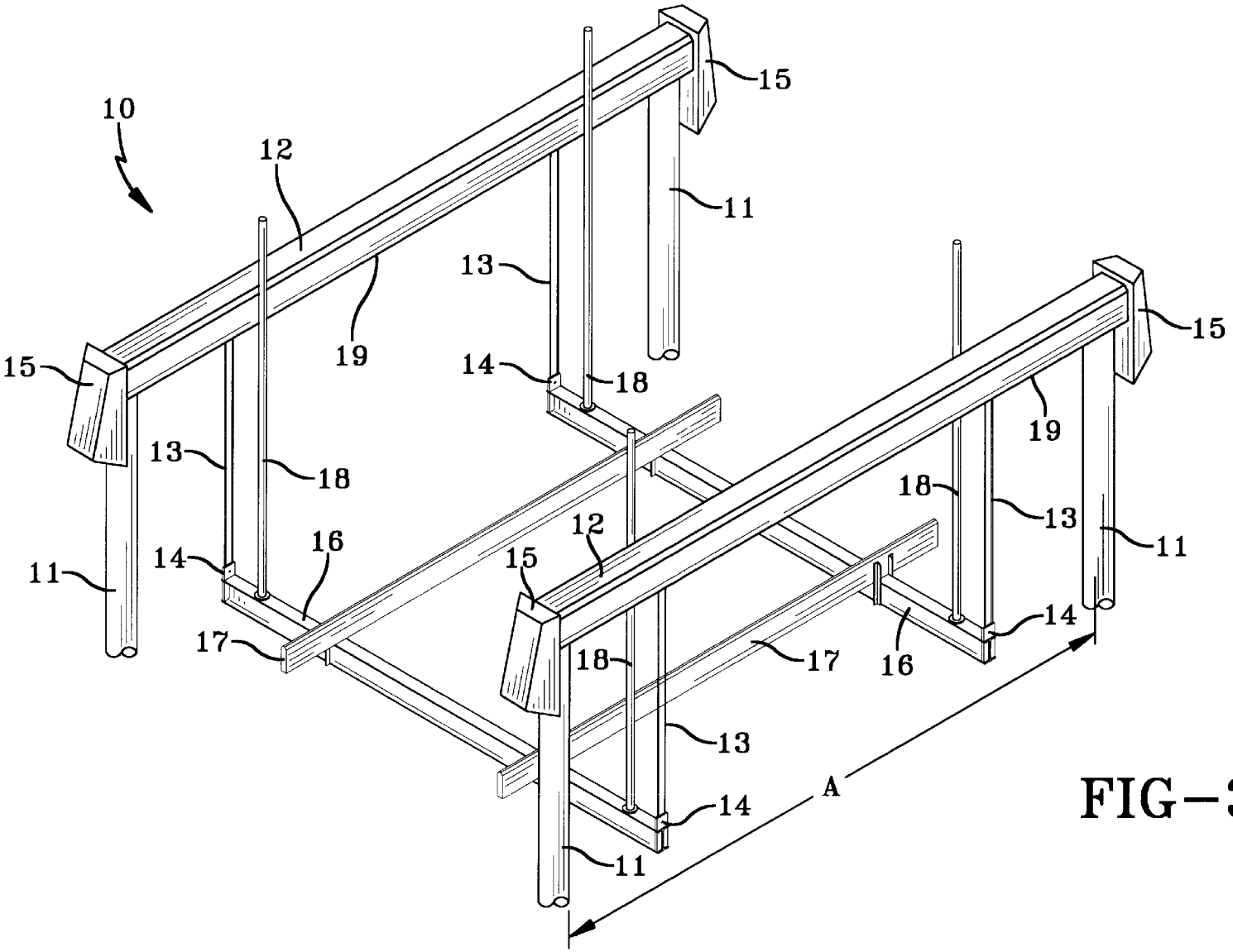
FIG. 3 shows a perspective view of another embodiment of an adaptable boat lift embodying features of the present invention.

Turning now to FIG. 3, an alternative embodiment of the boat lift 30 is shown in accordance with the present inventive concepts. The boat lift 20 comprises four of support pilings 11, topped by support beams 12. A drive shaft is concealed within the underside 19 of the support beams 12. Four motors 15 are attached to the support pilings 11. Two lower cradle beams 16 are placed parallel to each and are located below and at a ninety degree angle from the support beams 12. Pulleys 14 are connected to each end of the lower cradle beams 16. Cables 13 are affixed to the support beams 12. Boat bottom supporting beams 17 are placed parallel to each other and spaced sufficiently apart to allow a boat to be supported and are attached to and oriented at a ninety degree angle to the top surface of the cradle beams 16. Guide posts 18 are attached to the top surface of the cradle beams 16. The spacing A between the support pilings 11 is calculated based on the weight and length of the boat to be lifted.

Figure 4:
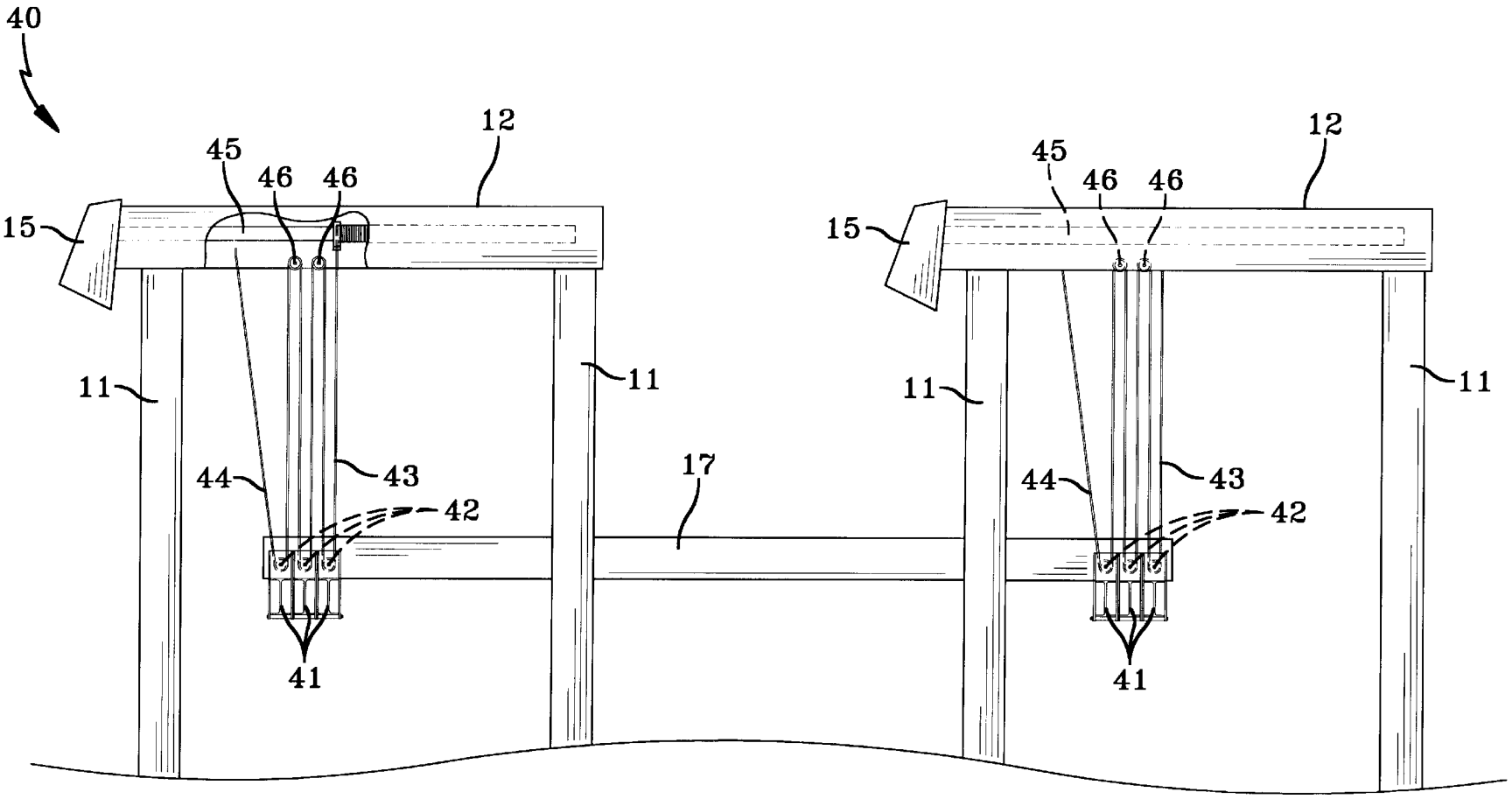
FIG. 4 shows a side view of another embodiment of an adaptable boat lift embodying features of the present invention.

Turning now to FIG. 4, an alternative embodiment of the boat lift 40 is shown in accordance with the present inventive concepts. The boat lift 40 comprises eight support pilings 11 (of which four are shown), each topped by a support beam 12. A drive shaft 45 is concealed within each support beam 12. Four motors 15 are attached to the support pilings 11 (of which two are shown in FIG. 4) as shown in FIG. 1. Three ten inch lower cradle beams 41 are placed parallel to each and are located below and at a ninety degree angle from the support beams 12. Cables 43 are anchored on one end of the cable 44 to the support beam 12. The cables 43 extend through pulley boxes 42 which are attached to each of the cradle beams 41 and extend through support beam pulleys 46. Alternatively, two lower cradle beams 41 may be used. Boat bottom supporting beams 17 are placed parallel to each other and spaced sufficiently apart to allow a boat to be supported and are attached to and oriented at a ninety degree angle to the top surface of the cradle beams 41. Guide posts are not shown but may be attached to the top surface of the cradle beams as shown in FIG. 1. The spacing between the support pilings 11 is calculated based on the weight and length of the boat to be lifted. The embodiment shown in FIG. 4 can be used to lift boats of up to about sixty thousand pounds.

Figure 5:
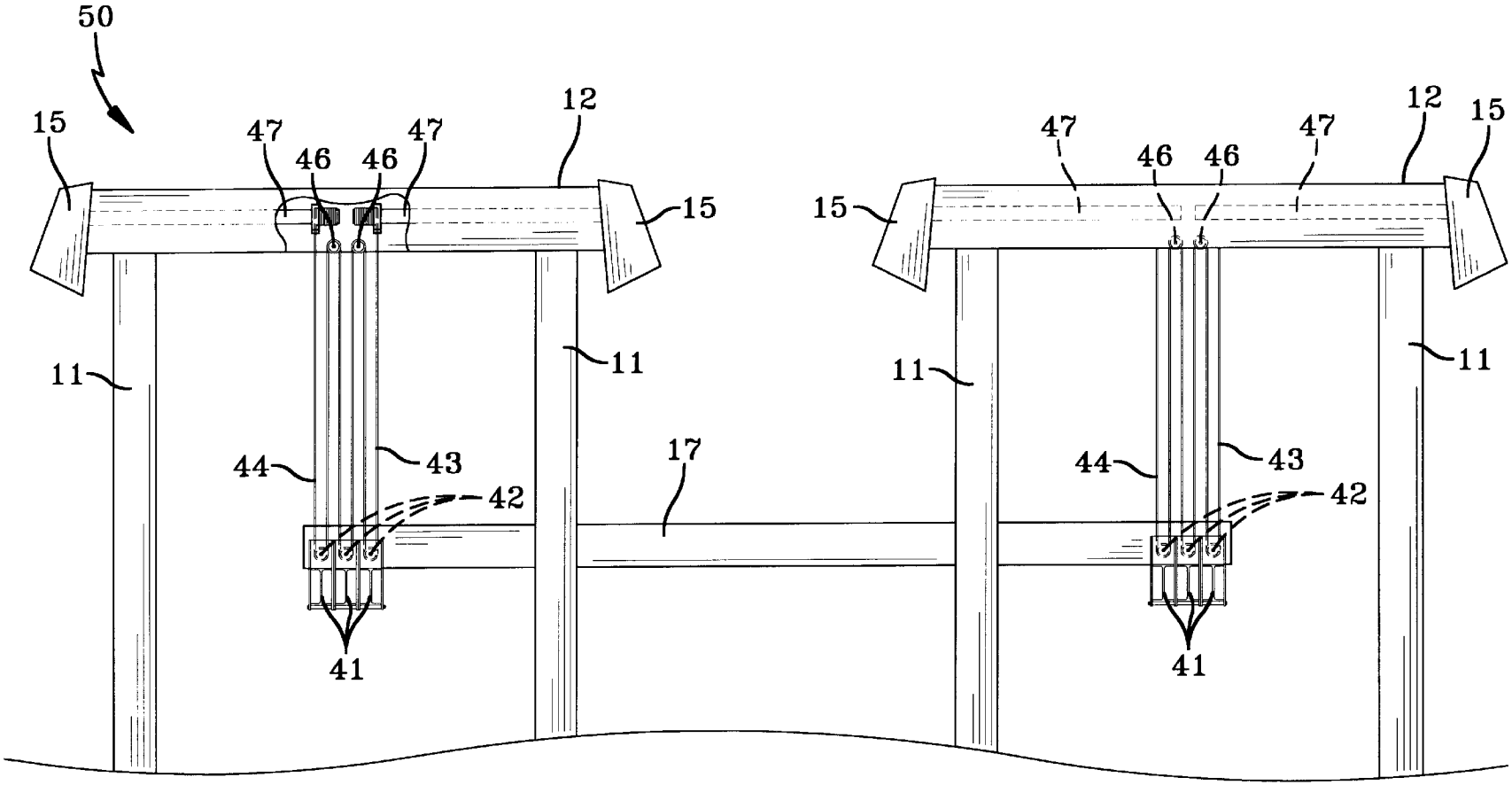
FIG. 5 shows a side view of another embodiment of an adaptable boat lift embodying features of the present invention.

Turning now to FIG. 5, an alternative embodiment of the boat lift 50 is shown in accordance with the present inventive concepts. The boat lift 40 comprises eight support pilings 11 (of which four are shown), each topped by a support beam 12. Two drive shafts 47 are concealed within each support beam 12. Eight motors 15 are attached to the support pilings 11 (of which four are shown in FIG. 5) as shown in FIG. 3. Three ten inch lower cradle beams 41 are placed parallel to each and are located below and at a ninety degree angle from the support beams 12. Cables 43 are anchored on one end of the cable 44 to the support beam 12. The cables 43 extend through pulley boxes 42 which are attached to each of the cradle beams 41 and extend through support beam pulleys 46. Alternatively, two lower cradle beams 41 may be used. Boat bottom supporting beams 17 are placed parallel to each other and spaced sufficiently apart to allow a boat to be supported and are attached to and oriented at a ninety degree angle to the top surface of the cradle beams 41. Guide posts are not shown but may be attached to the top surface of the cradle beams as shown in FIG. 3. The spacing between the support pilings 11 is calculated based on the weight and length of the boat to be lifted. The embodiment shown in FIG. 5 can be used to lift boats of up to about sixty thousand pounds.

Figure 6:
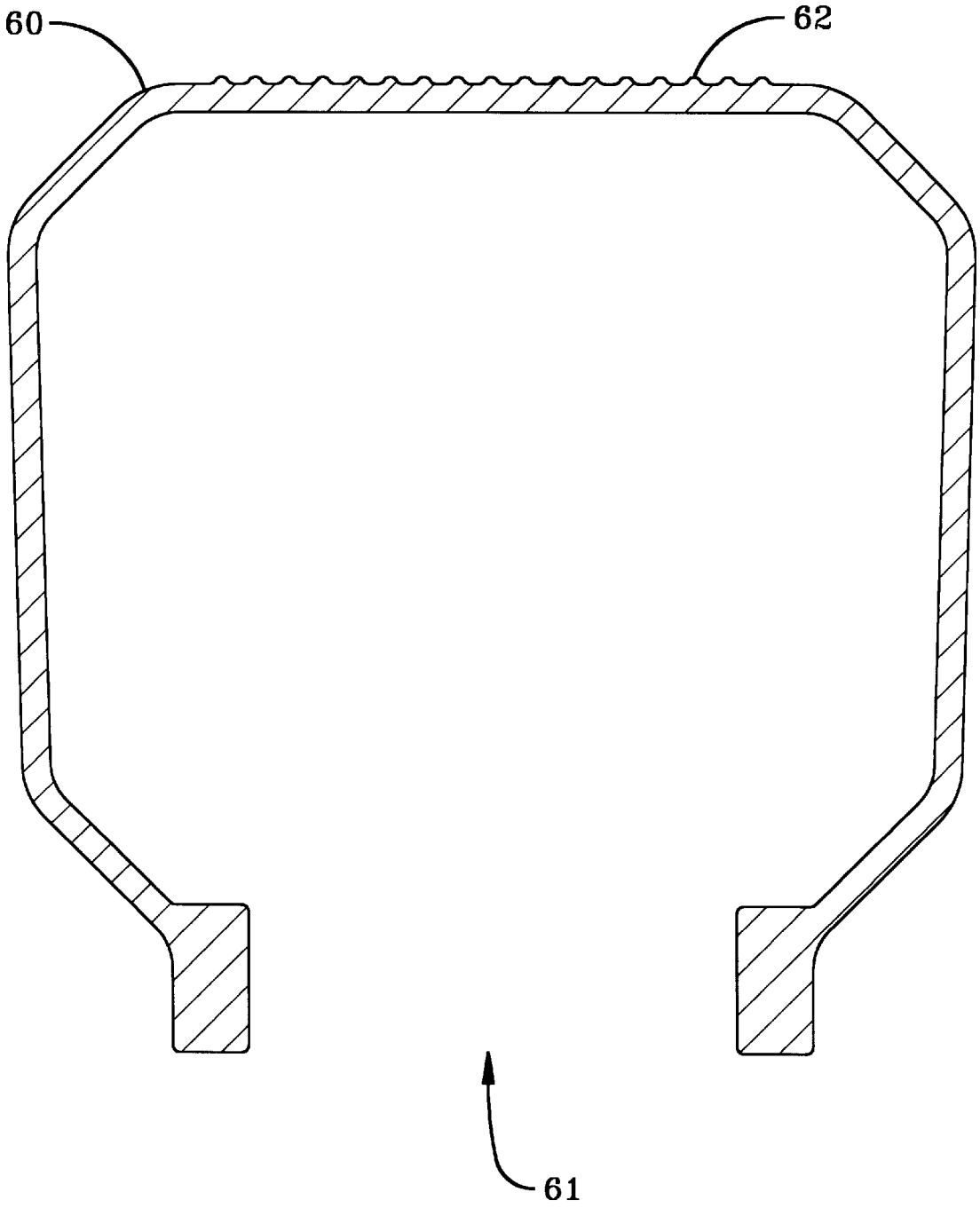
FIG. 6 shows a cross section of the C-shaped extruded channel support beam of an adaptable boat lift embodying features of the present invention.

Turning now to FIG. 6, a preferred embodiment of a cross section of the C-shaped extruded one-piece channel support beam 60 of the boat lift is shown in accordance with the present inventive concepts. The C-shaped beam has an opening 61 on one side and a ridged top 62. The opening 61 of the beam faces the top of the support pilings 11 as shown in FIG. 1.

Figure 7:
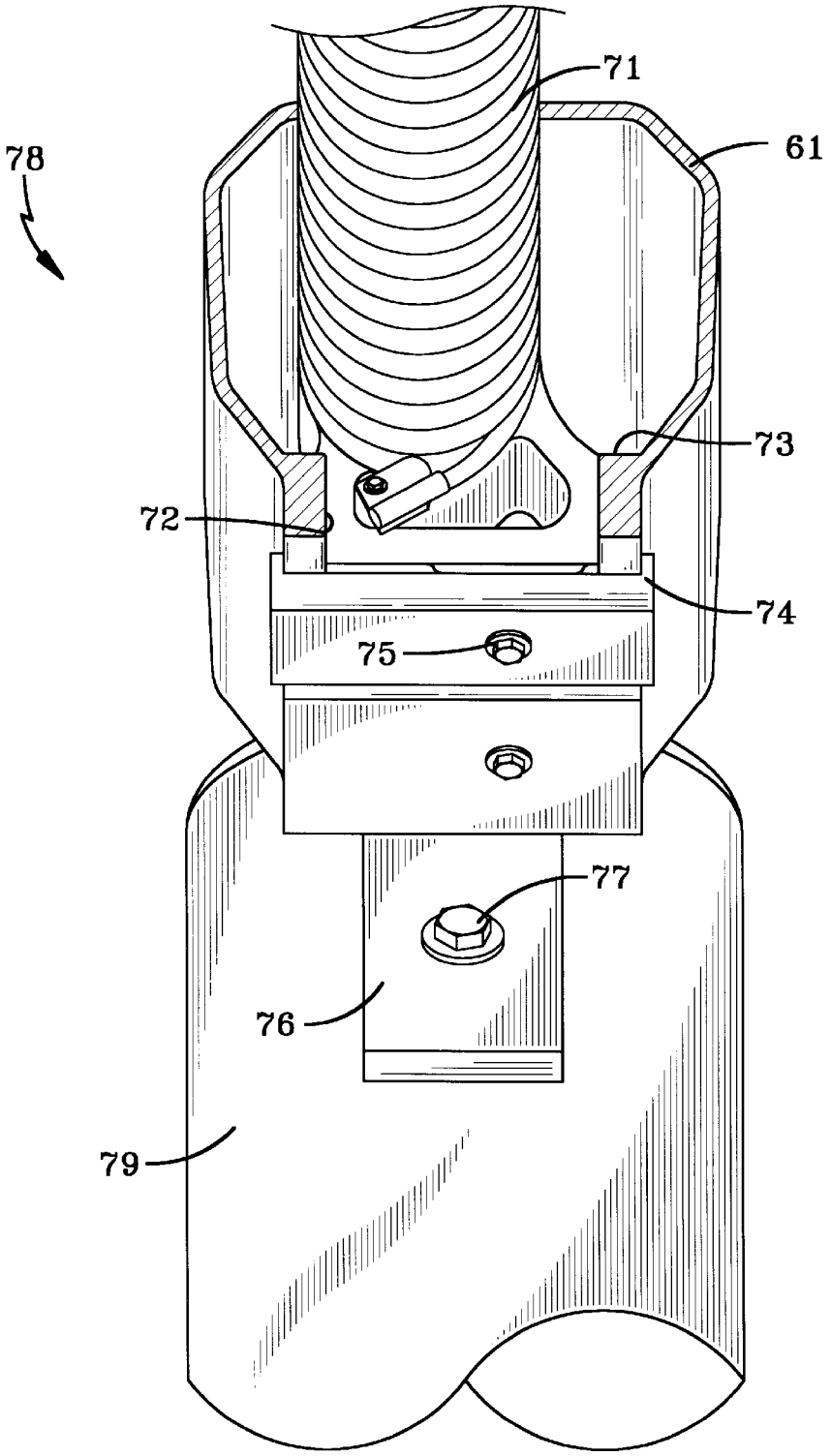
FIG. 7 shows an underside view of the C-shaped extruded channel support beam of an adaptable boat lift embodying features of the present invention.

Turning now to FIG. 7, a preferred embodiment of the underside of the support beam showing the opening 61 of the boat lift is shown in accordance with the present inventive concepts. The cable 71 is shown wound around the drive shaft 72 which is concealed within the opening 61 of the support beam 78. A bearing 73 is shown installed surrounding the drive shaft 72 with a bearing bolting bracket 74 and bolt 75 used to secure the bearing 73 to the underside of the support beam 78. The support beam pile bolting bracket 76 is shown with a bolt 77 that secures the support beam 78 to the support piling 79.

Figure 8:
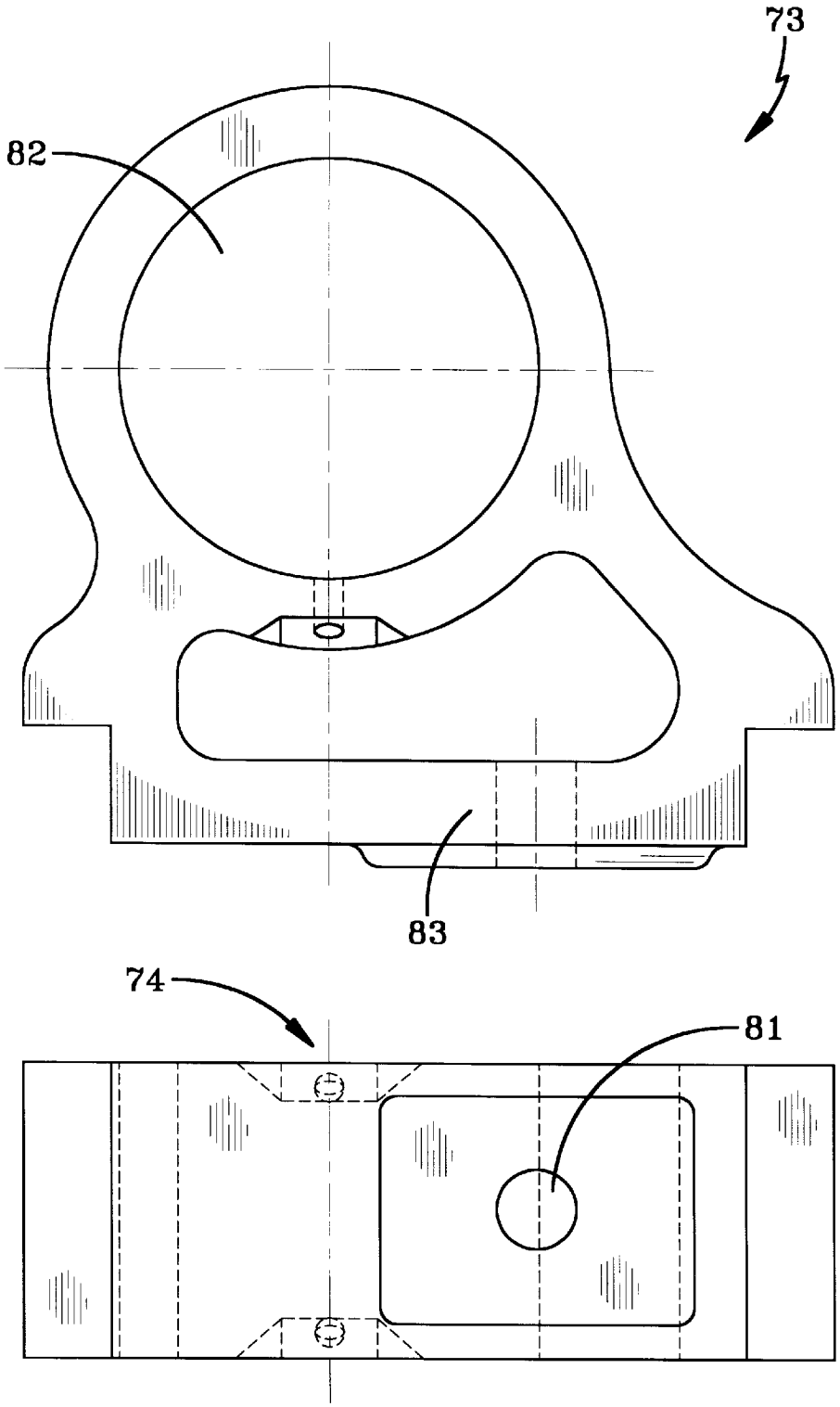
FIG. 8 shows a perspective view of a bearing of an adaptable boat lift embodying features of the present invention.

Turning now to FIG. 8, a preferred embodiment of a bearing 73 of the boat lift is shown in accordance with the present inventive concepts. The bearing 73 has a rounded opening 82 for accepting the drive shaft. The bolting bracket 74 has a hole for a bolt 81 with a corresponding bolt hole 83 in the bearing 73 which is used to secure the bearing 73 to the underside of the support beam 78 as shown in FIG. 7.

Although the present invention has been described in considerable detail with reference to certain preferred embodiments thereof, other embodiments are possible. Therefore, the spirit and scope of the appended claims should not be limited to the description of the preferred embodiments herein.

What is claimed is:

1. An adaptable boat lift for lifting and supporting a boat, comprising:

a. a plurality of support pilings spaced so as to form a rectangle;

b. a one piece extruded first support beam, attached to the support pilings that form one side of the rectangle;

c. a one piece extruded second support beam attached to the pilings that form the side of the rectangle opposite the first support beam;

d. at least one drive shaft enclosed within and extending the length of each support beam;

e. a mechanism for rotating the drive shaft in a clockwise and counterclockwise direction;

f. a plurality of cradle beams, spaced parallel to each other and sufficiently apart to support a boat, located below the support beams and oriented at a ninety degree angle to the support beams; and g. a plurality of lifting members, each lifting member comprising an elongated cable connected on one end to the support beam, attaching to the cradle beam and connected on the opposite end to the drive shaft whereby when the shaft is rotated the lifting member raises or lowers the cradle beams.

2. An adaptable boat lift, according to claim 1, wherein the support beams are C-shaped extruded channel beams with an opening on one side, mounted atop the support pilings, such that the opening in the channel support beam faces the top of the support pilings.

3. An adaptable boat lift, according to claim 2, wherein the C-shaped channel extruded support beam comprises a reinforced ribbed top section extending the length of the support beam.

4. An adaptable boat lift, according to claim 1, wherein the extruded support beams are formed of an aluminum alloy.

5. An adaptable boat lift, according to claim 1, further comprising one or more bearings mounted surrounding the drive shaft and attached to the underside of the channel support beam.

6. An adaptable boat lift, according to claim 5, wherein the bearings are cast aluminum alloy.

7. An adaptable boat lift, according to claim 1, further comprising:

a. one or more bearings mounted surrounding the drive shaft and attached to the underside of the support beam;

b. a pulley attached to each end of the lower cradle beams, whereby the lifting members extend through the pulley and support the cradle beams through the pulley; and c. the mechanism for rotating the shaft is a motor attached to the support pilings.

8. A boat lift for lifting and supporting a boat, according to claim 7, wherein two drive shafts are enclosed within and extending the length of each support beam, each drive shaft being connected to a motor installed on each end of each support beam.

9. A boat lift for lifting and supporting a boat, comprising:

a. a plurality of support pilings forming pairs, spaced so as to form a rectangle;

b. a C-shaped channel one piece extruded support beam with an opening on one side, mounted atop each pair of the support pilings that form one side of the rectangle such that the opening in the support beam faces the top of the support pilings;

c. at least one drive shaft mounted within the opening of each channel support beam and extending the length of the channel support beam;

e. one or more bearings mounted on the drive shaft and attached to the underside of the channel support beams;

f. a motor mechanism for rotating the drive shaft, attached to the support piling;

g. a plurality of lower cradle beams, placed parallel to each other and spaced sufficiently apart so as to support a boat, located below the channel support beams oriented at a ninety degree angle to the channel support beams;

h. a pulley connected to each end of the lower cradle beams;

i. a cable affixed to the support beam on one end and to the drive shaft on the other end, extending through the pulley connected to each end of the lower cradle beams;

j. a plurality of bottom supporting mechanisms, placed parallel to each other and spaced sufficiently apart to allow a boat to be supported, attached to the surface of the cradle beams facing the channel support beams, oriented at a ninety degree angle to the cradle beams for supporting a boat; and k. a plurality of guide posts attached to the top surface of the lower cradle beams spaced sufficiently apart to allow the hull of a boat to fit between the guide posts attached to the top surface of each cradle beam.

10. An adaptable boat lift, according to claim 9, wherein:

a. the number of support pilings is equal to four, forming two pairs; and b. the number of C-shaped channel one piece extruded support beams is equal to two.

11. An adaptable boat lift, according to claim 10, wherein:

a. the number of lower cradle beams is equal to two;

b. the number of pulleys is equal to four; and c. the number of cables is equal to two.

12. An adaptable boat lift according to claim 11, wherein the number of motors is equal to two.

13. An adaptable boat lift according to claim 11, wherein the number of motors is equal to four.

14. An adaptable boat lift according to claim 10, wherein:

a. the number of lower cradle beams is equal to three;

b. the number of pulleys is equal to six; and c. the number of cables is equal to two.

15. An adaptable boat lift according to claim 9, wherein:

a. the number of support pilings is equal to eight, forming four pairs; and b. the number of C-shaped channel one piece extruded support beams is equal to four.

16. An adaptable boat lift, according to claim 15, wherein:

a. the number of lower cradle beams is equal to four;

b. the number of pulleys is equal to eight; and c. the number of cables is equal to eight.

17. An adaptable boat lift according to claim 15, wherein the number of motors is equal to four.

18. An adaptable boat lift according to claim 15, wherein the number of motors is equal to eight.

19. An adaptable boat lift, according to claim 15, wherein:

a. the number of lower cradle beams is equal to six;

b. the number of pulleys is equal to twelve; and c. the number of cables is equal to four.

20. An adaptable boat lift, according to claim 15, wherein:

a. the number of lower cradle beams is equal to four;

b. the number of pulleys is equal to eight; and c. the number of cables is equal to four.

21. An adaptable boat lift, according to claim 9, wherein the channel support beams, drive shaft, bearings, motor mechanism and cradle beams are bolted into place for ease of installation, maintenance and replacement of failed or worn components and require no welded connections.

22. An adaptable boat lift, according to claim 9, wherein the boat lift is adaptable to lift a boat up to a maximum of about sixty thousand pounds by varying the number of support pilings from a minimum of two on each side of the rectangle to a maximum of four on each side of the rectangle.

23. An adaptable boat lift, according to claim 9, wherein the boat lift is adaptable to lift a boat up to a maximum of about sixty thousand pounds by increasing the thickness of the lower cradle beam.

24. An adaptable boat lift, according to claim 9, wherein the boat lift is adaptable to lift a boat up to a maximum of about sixty thousand pounds by matching the power of the motors to the load requirements of the boat to be lifted.

25. An adaptable boat lift, according to claim 9, wherein the boat lift is adaptable to lift a boat up to a maximum of about sixty thousand pounds by increasing the number of motors driving the shaft and attached to the support pilings from a minimum of two to a maximum of eight.

26. An adaptable boat lift, according to claim 9, wherein the boat lift is adaptable to lift a boat up to a maximum of about sixty thousand pounds by increasing the number of bearings mounted on the drive shaft and attached to the underside of the support beam.

27. An adaptable boat lift, according to claim 9, wherein:

a. the number of pilings is selected according to the weight and length of the boat;

b. the spacing between the pilings is determined according to the length and weight of the boat;

c. the length of the extruded support beam corresponds to the spacing between the pilings;

d. the thickness of the cradle beams is based on the weight and length of the boat;

e. the number of motors for rotating the drive shaft is based on the weight of the boat; and f. the size and number of bearings attached to the support beams and surrounding the drive shaft are based on the weight of the boat.

28. An adaptable boat lift, according to claim 9, wherein the boat to be lifted is up to about sixteen thousand pounds and the spacing between the pilings forming each side of the rectangle and supporting the supporting beams is a maximum of about eighteen feet, and the first and second lower cradle beams comprise an ten inch I-beam.

29. An adaptable boat lift, according to claim 9, wherein the boat to be lifted is up to about twelve thousand pounds and the spacing between the pilings forming each side of the rectangle and supporting the supporting beams is a maximum of about eighteen feet, and the first and second lower cradle beams comprise an eight inch I-beam.

30. An adaptable boat lift, according to claim 9, wherein the boat to be lifted is up to about ten thousand pounds and the spacing between the pilings forming each side of the rectangle and supporting the supporting beams is a maximum of about twelve feet, and the first and second lower cradle beams comprise a six inch I-beam.

31. An adaptable boat lift, according to claim 9, wherein the one piece extruded beam is formed of an aluminum alloy.

32. An adaptable boat lift, according to claim 9, wherein the bearings are cast aluminum alloy.

33. An adaptable boat lift, according to claim 9, wherein the number of bearings and bearing size are matched to the weight of the boat to be lifted.

34. A boat lift for lifting and supporting a boat, according to claim 9, wherein two drive shafts are enclosed within and extending the length of each support beam, each drive shaft being connected to a motor installed on each end of each support beam.

* * * * *